US005977700A

United States Patent [19]

Lee

[11] Patent Number: 5,977,700

[45] Date of Patent: Nov. 2, 1999

[54] DEFLECTION YOKE FOR CATHODE RAY TUBE AND METHOD OF MAKING THEREOF

[75] Inventor: Seok-Moon Lee, Seoul, Rep. of Korea

[73] Assignee: LG Electronics Inc., Seoul, Rep. of Korea

[21] Appl. No.: 08/995,545

[22] Filed: Dec. 22, 1997

[30] Foreign Application Priority Data

Dec. 23, 1996 [KR] Rep. of Korea ..... 96-70447

[51] Int. Cl.[6] ..... H01J 29/56

[52] U.S. Cl. ..... 313/440; 335/213; 335/299

[58] Field of Search ..... 313/440, 426, 313/431; 335/210, 213, 296, 299

[56] References Cited

U.S. PATENT DOCUMENTS 5,121,028 6/1992 Milili ..... 335/213
5,170,094 12/1992 Giannantonio et al. ..... 313/440 X
5,506,469 4/1996 Vink et al. ..... 313/440
5,614,782 3/1997 Kim ..... 313/440
5,744,904 4/1998 Chang-Fa ..... 335/210

*Primary Examiner*—Ashok Patel
*Attorney, Agent, or Firm*—Finnegan, Henderson, Farabow, Garrett & Dunner, L.L.P.

[57] ABSTRACT

A deflection yoke for a CRT (cathode ray tube), including a flat wire to compensate for the convergence and upper and lower raster distortions of the electron beams, thereby forming images of high quality, and a method of making the deflection yoke. The deflection yoke has a horizontal coil adjacent the cathode ray tube, a vertical coil at least partially surrounding a ferrite core, a holder between the horizontal and vertical coils for electrically insulating the horizontal and vertical coils from one another, and a flat wire coupled to the holder for correcting convergence errors.

10 Claims, 5 Drawing Sheets

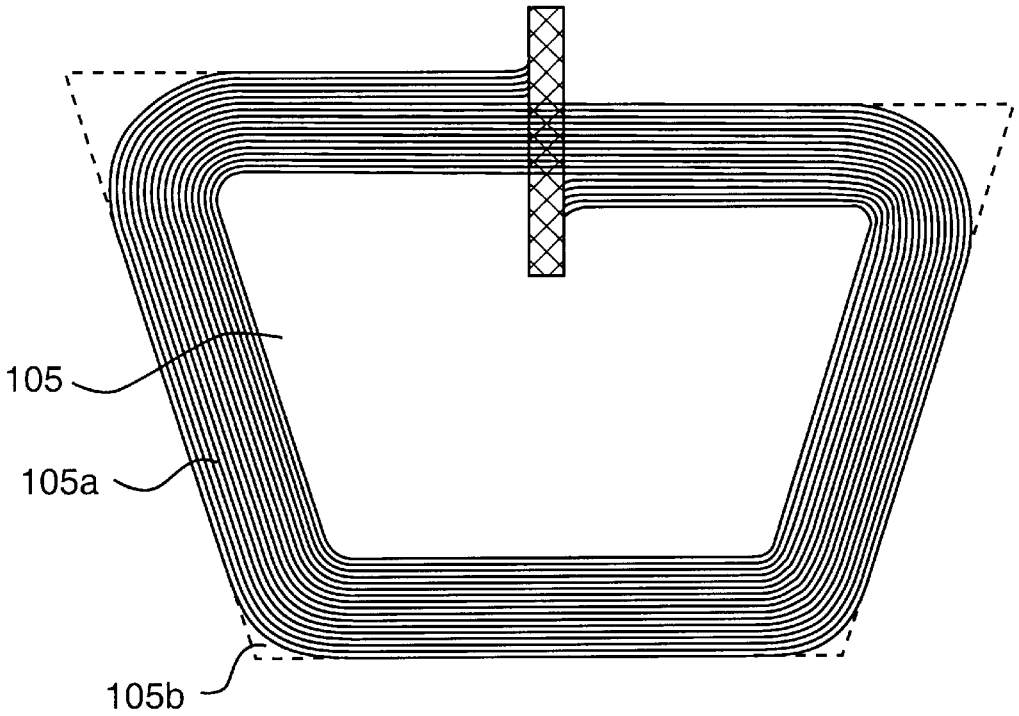
FIG.8(a)
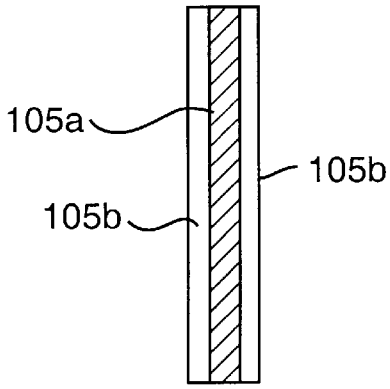
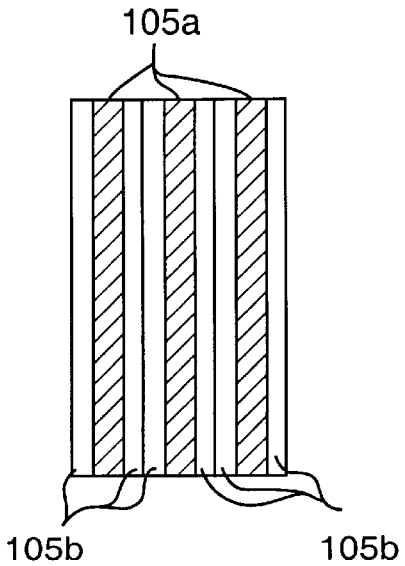
FIG.8(b) FIG.8(c)

DEFLECTION YOKE FOR CATHODE RAY TUBE AND METHOD OF MAKING THEREOF

BACKGROUND OF THE INVENTION

A. Field of the Invention

The present invention relates to a deflection yoke for a CRT (cathode ray tube), including a device for correcting misconvergence and upper and lower raster distortions of the electron beams, thereby forming images of high quality.

B. Description of the Prior Art

A conventional CRT, as shown in FIG. 1, comprises a panel 2 having an RGB fluorescent film 1 on the inner surface, a funnel 3 fused to the rear end of the panel 2, electron guns 5 sealed in the neck 4 of the fumnel 3, a deflection yoke 6 for deflecting electron beams generated from the electron guns 5 onto the whole surface of the fluorescent film 1, and a shadow mask 7 installed in the panel 2 and having a plurality of holes so as for the deflected electron beams to pass through.

The deflection yoke 6 is composed of a horizontal deflection coil 8 for horizontally deflecting the electron beams generated from the electron guns 5, a vertical deflection coil 9 for vertically deflecting the electron beams, a conical ferrite core 10 to enhance the magnetic efficiency by reducing the loss of magnetic force generated from the horizontal and vertical deflection coils 8 and 9, and a holder 11 fixing horizontal and vertical deflection coils 8 and 9 and ferrite core 10 at defined positions and isolating the horizontal deflection coil from the vertical one 9.

As shown in FIG. 6, the horizontal coil 8 consists of a main coil 81, and an auxiliary coil 12 that is independently formed between the middle and opening portions of the main coil 81. As shown in FIG. 2, the auxiliary coil 12 is positioned between the middle and opening portions on the inner surface of the holder 11, generating a local horizontal defection magnetic field.

Below describes the operation of the conventional deflection yoke as constructed above.

When the CRT is activated with power, electron guns (not shown) generate electron beams, which are deflected by the deflection yoke 6.

As mounted on the inner surface of the holder 11 and affected by the horizontal deflection magnetic field, the auxiliary coil 12 generates the magnetic field which forms a second magnetic field in such a direction that would oppose the horizontal deflection magnetic field generated by the main coil 81 of the horizontal deflection coil 8 according to the Lenz's law (the magnetic field induced by the current is in a direction that the current it would produce compensates for the change which causes the induced magnetic field). Consequently, the whole horizontal deflection magnetic field a' forms a local, horizontal deflection pin magnetic field b', as shown in FIG. 3.

Where convergence errors occur as shown in (a) of FIG. 4, the horizontal deflection pin magnetic field compensates for the convergence errors of the horizontal, red and blue beams R and B, so that the red and blue beams correspond with each other as shown in (b) of FIG. 4.

With upper and lower raster distortions errors as shown in (a) of FIG. 5, the horizontal deflection pin magnetic field compensates for the upper and lower distortion errors on the screen to be correspondence with each other as shown in (b) of FIG. 5.

Such a conventional deflection yoke for CRTs has an auxiliary coil that is made by winding a copper wire of the same type as the main coil of the horizontal deflection coil with a desired number of turns by use of an auxiliary coil-winding die, applying currents to both ends of the coil so as to melt the adhesive layer deposited on the surface of the copper coil, forming a desired shape of the auxiliary coil, and making a closed circuit by peeling the coating off the auxiliary coil at both ends and connecting both naked ends by a soldering step. The complexity of this process for making an auxiliary coil increases the number of processes and also requires a separate winding machine, with a consequence of an increase in production cost for the auxiliary coil and profit reduction of companies.

While the auxiliary coil is formed with uniform internal profile by the aid of a winding die the external profile of the auxiliary coil may be adversely affected by the state of winding. This affects the deflection magnetic field generated from the auxiliary coil for its intensity and profile, which leads to misconvergence and deviation of raster distortion on the screen.

In an installation the auxiliary coil is too inflexible to mount in accordance with the curvature of the inner surface of the holder, which also causes the above problems with the misconvergence and deviation of raster distortion on the screen.

SUMMARY OF THE INVENTION

An object of the present invention is to obviate one or more of the problems due to limitations and disadvantages of the related art.

Accordingly, an object of the present invention is to provide a deflection yoke for CRTs that is designed to compensate for the convergence error and upper and lower raster distortions of electron beams, improve the installation of an auxiliary coil and simplify the manufacturing process for a curtailment of production cost.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a horizontal coil adjacent the cathode ray tube, a vertical coil at least partially surrounding a ferrite core, a holder between the horizontal and vertical coils for electrically insulating the horizontal and vertical coils from one another, and a flat wire coupled to the holder for correcting convergence errors.

The invention further comprises printing one or more wires arranged in parallel forming a closed loop on a first heat resistant material, disposing a second heat resistant material over one or more printed wires to form a flat wire, and disposing the flat wire on the holder.

It is to be understood that both the foregoing general description and the following detailed description are exemplary and explanatory only and are not restrictive the invention, as claimed.

The accompanying drawings, which are incorporated in and constitute a part of this specification, illustrate embodiments of the invention and together with the description, serve to explain the principles of the invention.

BRIEF DESCRIPTION OF THE DRAWINGS

FIG. 8(*a–c*) is a detailed view of a flat wire attached to the deflection yoke for CRTs according to an embodiment of the present invention.

DETAILED DESCRIPTION OF PREFERRED EMBODIMENTS

Reference will now be made in detail to the present preferred embodiments of the invention, examples of which are illustrated in the accompanying drawings.

Figure 7:
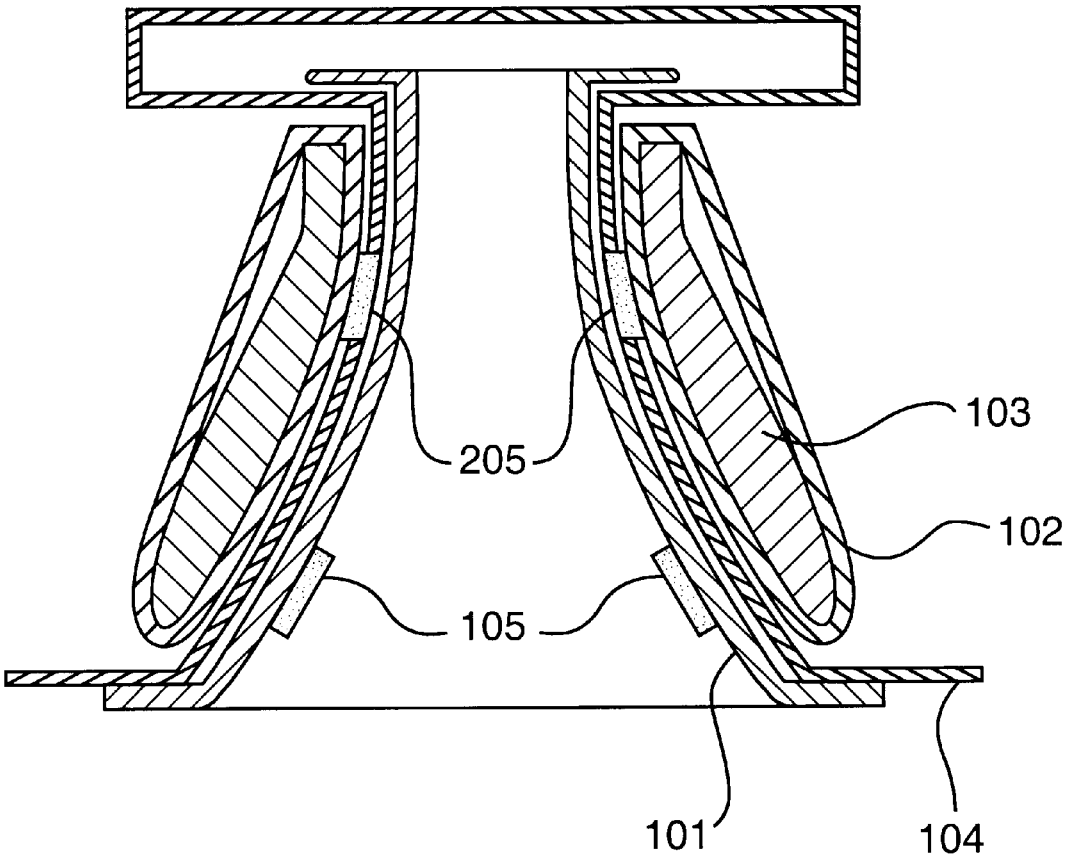
FIG. 7 is a cross section of the deflection yoke according to an embodiment of the present invention.

FIG. 7 shows a construction of a deflection yoke for CRTs in accordance with an embodiment of the present invention.

Referring to FIG. 7, the deflection yoke consists of a horizontal deflection coil 101 for horizontally deflecting electron beams generated from electron guns (not shown), a vertical deflection coil 102 for vertically deflecting the electron beams, a conical ferrite core 103 to enhance the magnetic efficiency by reducing the loss of magnetic force generated from the horizontal and vertical deflection coils 101 and 102, and a holder 104 for fixing horizontal and vertical deflection coils 101 and 102 and ferrite core 103 at designated positions and isolating the horizontal deflection coil 101 from the vertical one 102.

Between the middle and opening portions on the inner surface of the holder 104 is attached a flat wire 105.

The flat wire 105, as shown in FIG. 8, is made by constructing a closed circuit consisting of a plurality of wires connected in parallel on a base made of heat-resistant material by using the printer technique, and disposing a second base of heat-resistant material over the base.

In another embodiment of the present invention, flat wire 205 is interposed between the middle and neck of the outer surface of holder 104.

Below describes the operation of the deflection yoke of an embodiment of the present invention as constructed above.

When the CRT is activated with power, electron guns (not shown) generate electron beams, which are deflected by the deflection yoke.

Figure 1:
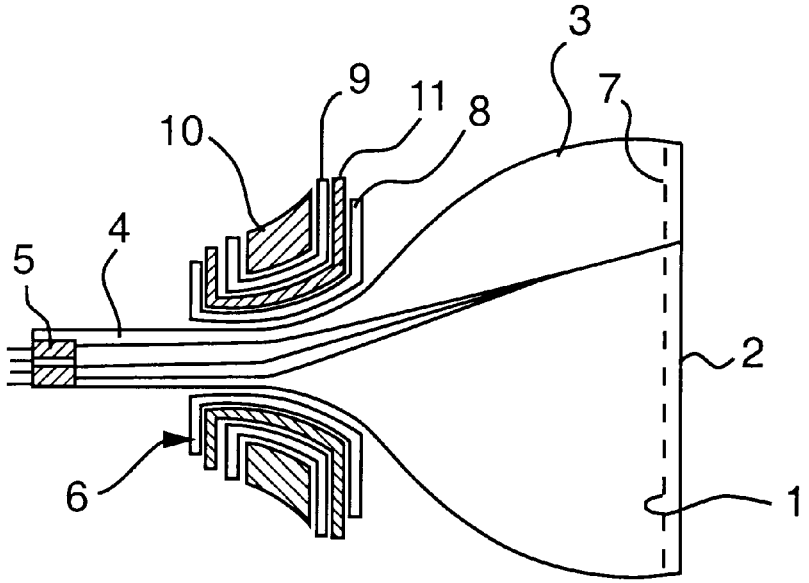
FIG. 1 is a vertical cross section of a conventional deflection yoke for CRTs.
Figure 2:
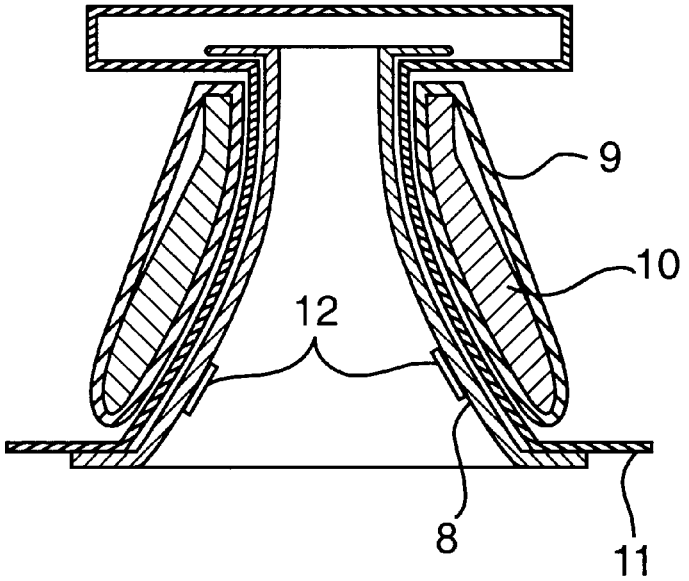
FIG. 2 is a cross section of the conventional deflection yoke for CRTs.
Figure 3:
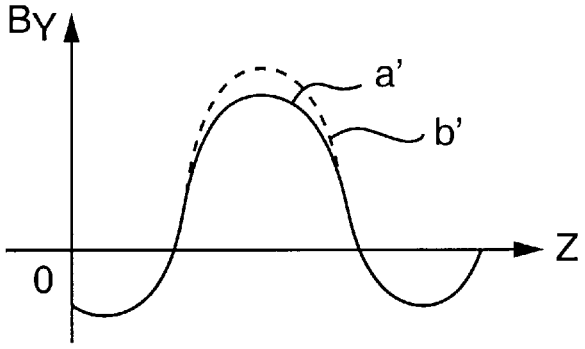
FIG. 3 shows a comparison of the horizontal deflection magnetic field before and after an installation of an auxiliary coil of the conventional deflection yoke for CRTs.
Figure 4A:
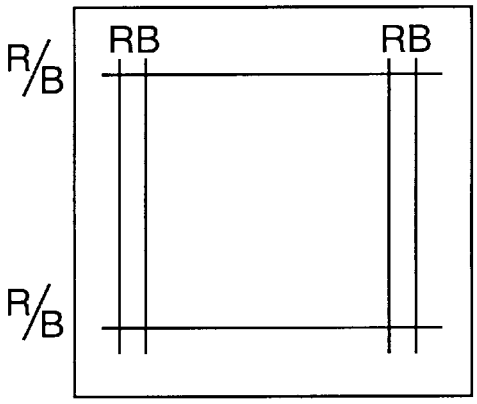
FIG. 4 is a detailed view showing: (a) the convergence error of electron beams before an installation of an auxiliary coil of the conventional deflection yoke for CRTs; and (b) the convergence error of electron beams compensated after an installation of an auxiliary coil of the conventional deflection yoke for CRTs.
Figure 4B:
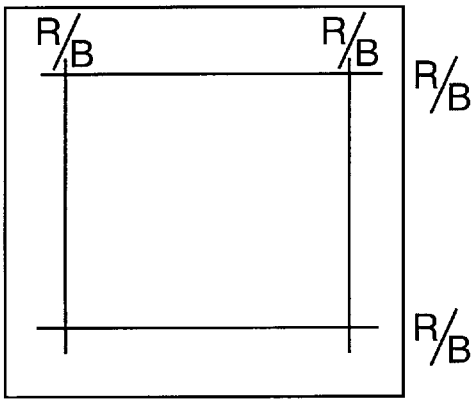

As mounted between the middle and opening portions of the inner surface of the holder 104 and affected by the horizontal deflection magnetic fields, the flat wire 105 generates the magnetic field which forms a second magnetic field in such a direction that would oppose the horizontal deflection magnetic field generated by the horizontal deflection coil 101 according to the Lenz's law (the magnetic field induced by the current is in a direction that the current it would produce compensates for the change which causes the induced magnetic field). As a consequence, the whole horizontal deflection magnetic field a' forms a local, horizontal deflection pin magnetic field b', as shown in FIG. 3.

Where convergence errors occur as shown in (a) of FIG. 4, the horizontal deflection pin magnetic field compensates tor the convergence errors of the horizontal, red and blue beams R and B, so that the red and blue beams correspond with each other as shown in (b) of FIG. 4.

Figure 5A:
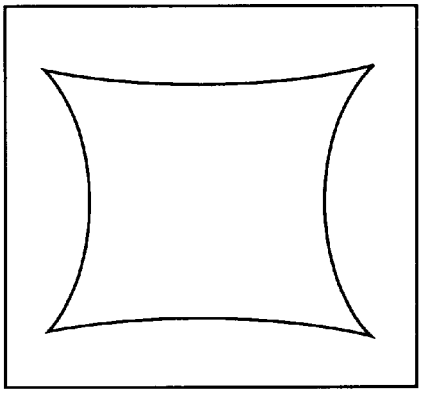
FIG. 5 is a detailed view showing: (a) the upper and lower raster distortion error of electron beams before an installation of an auxiliary coil of the conventional deflection yoke for CRTs; and (b) the upper and lower raster distortion error of electron beams compensated after an installation of an auxiliary coil of the conventional deflection yoke for CRTs.
Figure 5B:
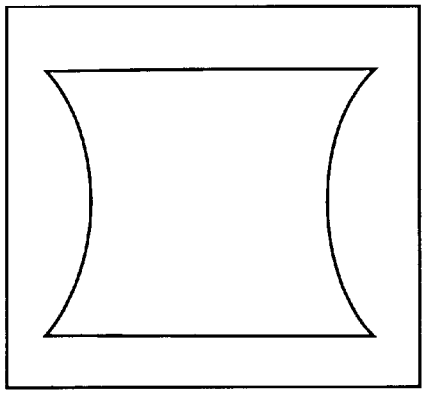
Figure 6:
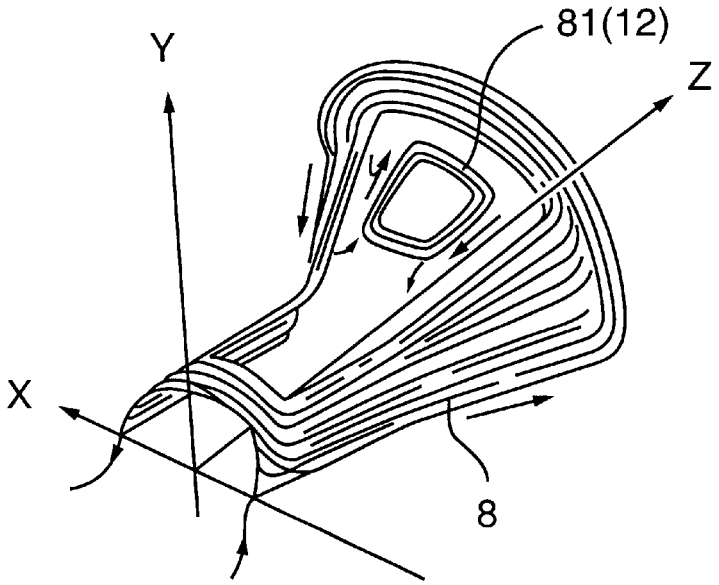
FIG. 6 is a detailed view of an auxiliary coil attached to the conventional deflection yoke for CRTs.

With upper and lower raster distortion errors as shown in (a) of FIG. 5, the horizontal deflection pin magnetic field compensates for the upper and lower raster distortion errors on the screen to be in correspondence with each other as shown in (b) of FIG. 5.

As described above, an embodiment of the present invention is also directed to the method of manufacturing a flat wire by constructing a closed circuit coil of a desired profile by the print technique and interposing it between upper and lower bases made of heat-resistant material, thus maintaining the profile of the closed circuit and improving the deviation of the deflection yoke. Where the effect of the flat wire is needed to be maximized to compensate for more convergence errors and upper and lower raster distortions, the compensation effect can be increased with ease in the present invention with the thin flat wire. The profile of the flat wire is able to be designed with complexity for a required horizontal deflection magnetic field and the flat wire can also be manufactured on a large scale by way of the print technique, saving the production cost. Easy modifications of the flat wire can be achieved by changing the profile of the flat wire, the number of turns for a closed circuit coil without additional cost for a separate molding die production. Furthermore, the flat wire is very thin and has high flexibility sufficient that it can be closely adhered to the inner surface of the holder with a consequence of realization of a deflection yoke of high quality.

It will be apparent to those skilled in the art that various modifications and variations can be made in the deflection yoke for CRTs of the present invention and in construction of this deflection yoke without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A deflection yoke for a cathode ray tube, comprising:

a horizontal coil adjacent the cathode ray tube;

a vertical coil at least partially surrounding a ferrite core;

a holder between said horizontal and vertical coils for electrically insulating said horizontal and vertical coils from one another; and a flat wire coupled to said holder for correcting convergence errors.

2. The deflection yoke as defined in claim 1, wherein said flat wire includes one or more wires arranged in parallel forming a closed loop.

3. The deflection yoke as defined in claim 1, wherein said flat wire is positioned between the vertical coil and an inner surface of the holder adjacent the vertical coil.

4. The deflection yoke as defined in claim 1, wherein said flat wire is positioned between the horizontal coil and an outer surface of the holder adjacent the horizontal coil.

5. The deflection yoke as defined in claim 2, wherein each of said one or more wires is interposed between a first heat-resistant material and a second heat-resistant material.

6. A deflection yoke for a cathode ray tube, comprising:

a horizontal coil adjacent the cathode ray tube;

a vertical coil at least partially surrounding a ferrite core;

a holder between said horizontal and vertical coils for electrically insulating said horizontal and vertical coils from one another; and a first flat wire coupled to said horizontal coil for correcting convergence errors.

7. The deflection yoke as defined in claim 6, further comprising a second flat wire coupled to said holder for correcting convergence errors.

8. The deflection yoke as defined in claim 6, wherein said horizontal coil has an inner surface facing opposite said holder and wherein said flat wire coupled to said inner surface of the horizontal coil.

9. The deflection yoke as defined in claim 6, wherein said flat wire includes one or more wires arranged in parallel forming a closed loop.

10. The deflection yoke as defined in claim 9, wherein each of said one or more wires is interposed between a first heat treated material and a second heat treated material.

* * * * *